United States Patent [19]

Avnery

[11] Patent Number: 4,591,756

[45] Date of Patent: May 27, 1986

[54] HIGH POWER WINDOW AND SUPPORT STRUCTURE FOR ELECTRON BEAM PROCESSORS

[75] Inventor: Tzvi Avnery, Winchester, Mass.

[73] Assignee: Energy Sciences, Inc., Woburn, Mass.

[21] Appl. No.: 705,020

[22] Filed: Feb. 25, 1985

[51] Int. Cl.[4] ..... H01J 33/04

[52] U.S. Cl. ..... 313/420; 250/503.1; 250/492.3

[58] Field of Search ..... 250/503.1, 493.1, 492.1, 250/492.3; 313/359.1, 420

[56] References Cited

U.S. PATENT DOCUMENTS

| | | | |
|---|---|---|---|
| 2,449,872 | 9/1948 | Brasch et al. | 313/420 |
| 3,440,466 | 4/1969 | Colvin et al. | 313/35 |
| 3,442,466 | 5/1969 | Fritsche | 242/107.4 |
| 3,702,412 | 11/1972 | Quintal | 313/299 |
| 3,769,600 | 10/1973 | Denholm et al. | 328/233 |
| 4,100,450 | 7/1978 | Frutiger et al. | 313/360 |
| 4,362,965 | 12/1982 | Kendall | 313/420 |

*Primary Examiner*—Alfred E. Smith
*Assistant Examiner*—Jack I. Berman
*Attorney, Agent, or Firm*—Rines and Rines, Shapiro and Shapiro

[57] ABSTRACT

A high power window for an evacuated electron beam generator and the like which comprises one or more pluralities of conductive successive fins parallelly and closely spaced arcuately extending transversely across the electron beam foil window and held by the vacuum pressure to the inner surface thereof, with the fin cross-section preferably tapering in thickness inwardly.

16 Claims, 8 Drawing Figures

HIGH POWER WINDOW AND SUPPORT STRUCTURE FOR ELECTRON BEAM PROCESSORS

The present invention relates to electron discharge devices and more particularly to an improved electron beam processor high power window and support structure for quantitatively increasing the sustainable output of such devices as, for example, in continuous irradiation processes.

Prior high power electron beam processor windows, including their support structures, such as rows of fins that not only support the metallic electron-beam-permeable window foil against atmospheric pressure, but serve as heat sinks and/or heat transfer media to a cooling fluid—such as shown, for example, in U.S. Pat. No. 3,440,466—suffer from electron beam interception problems and ultimate window-collapse problems due to thermal expansion and related factors, in use. Window structures of the type disclosed, for example, in U.S. Pat. No. 3,440,466, may permit a 75% to 98% transmission factor (25% to 2% interception of the perpendicular electrons by the fins), but when wider than about 0.5 inch, have been found to be subject to fin collapsing due to such thermal expansion and related effects. With such a configuration, the length of the fin is much larger than the thickness, such that longer window frames become subject to vacuum deflection which buckles the fins even apart from the problem of thermal expansion. Increasing the thickness or number of fins, moreover, reduces the quantity of electrons passing through the window due to increased non-perpendicular electron beam interception.

The window foil closing off the vacuum (such as an aluminum foil 0.001 inch thick) suffers from both thermal and mechanical stresses which are proportional to the square of the distance between adjacent fins. Aluminum foils, moreover, cannot withstand high temperatures and also deteriorate because of atmospheric chemical corrosion effects. For high power usage, when the window foil operates at its optimum conditions, that distance becomes critical as the fins thermally expand and buckle. The foil then fails and cannot hold the vacuum.

It is therefore an object of the present invention to provide a new and improved high power electron-beam window structure, including its support, that is not subject to the above disadvantages of prior windows, but is less sensitive to operational environmental conditions that heretofore have promoted buckling, even for large windows, high power, and/or long process zones.

Another object is to provide a novel high power foil window structure that is capable of limiting the current density in the window, thus providing an extension of high power handling capability.

A further object is to provide such a high power window that also possesses a high transmission factor.

A still further object is to provide such a high power window structure that suffers minimal non-perpendicular electron beam interception.

Other and further objects will be explained hereinafter and are more particularly delineated in the appended claims.

In summary, from one of its important aspects, the invention involves a high power window for an evacuated electron beam generator and the like having, in combination, a longitudinally extending metallic foil window closing off the vacuum, and one or more pluralities of sets of successive parallely and closely spaced accurately extending conductive fins held by the vacuum pressure to the inner surface of the foil and curving transversely across said inner surface between its longitudinal edges. Preferred constructional details and best mode embodiment are hereinafter presented.

The invention will now be described with reference to the accompanying drawings:

FIGS. 1A and 1B of which are top plan views of windows embodying two types of fins particularly useful in accordance with the the present invention;

Figure 1A:
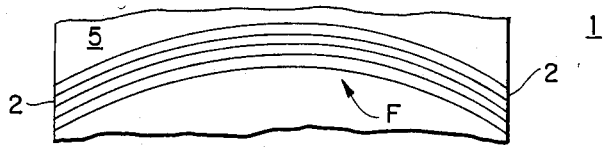
Figure 1B:
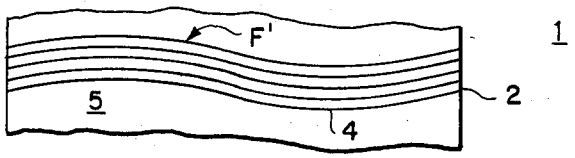

Referring now to the plan view of FIGS. 1A and 1B, a high power window for an electron discharge device such as an electron beam irradiating processor or generator is generally designated at 1, having an electron-permeable foil 5 bounded by a frame including rigid edge supports or walls 2 extending the length of the window. Secured between and contacting the edge walls 2 of the frame are a plurality of curvalinear fins F (FIG. 1A) and F' (FIG. 1B). The fins F are shown in the form of a continuous arc having a single radius of curvature, while the fins F' are illustrated in the form of multiple curved portions of S-shape. The fins in the frame are pressed against the metallic foil window 5 when the same is assembled to close off the evacuated electron beam generator, having the 14.7 p.s.i. differential pressure between the vacuum and the atmosphere on opposite sides of the window holding the same against the fins in heat transfer contact. The electron beam is directed orthogonal to the plane of the window, into the drawing in FIGS. 1A and 1B.

As mentioned previously, the window assembly is subject to thermal and mechanical loads in use. The thermal load is generated at the window 1 when the electron beam, generated by the electron discharge device (not shown—such as, for example, of the type described in U.S. Pat. Nos. 3,702,412, 3,769,600 and 4,100,450), transmits electrons downward in FIGS. 1A and 1B, through the vacuum of the device and then through the foil window 5 and into the atmosphere outside the window (below, in FIGS 1A and 1B). This is basically due to five factors: (1) the interception of the perpendicular electron beam, (2) interception of the non-perpendicular electron beam, (3) electrons losing some of their energy while passing through the foil 5, (4) back scattering of electrons from the air and from the product, and (5) heat generated on the atmospheric side of the window as a result of the electron beam or chemical reactions, etc.

The curving of the fins F or F' of the present invention along the plane perpendicular to the electron discharge path mitigates against the problem of uncontrolled thermal deflection and buckling inherent in prior windows, as with linear or straight fins, since all of the curved fins F will thermally expand in the same direction and by the same amount (which is a much smaller amount than in the case of linear fins). The foil window 5, supported by the fins, thus suffers considerably less thermal and/or mechanical stress effects.

Other advantages flowing from the use of such arcuately curved fins F include improvement in: (1) the power handling capabilities of the electron beam through the window, i.e. the limiting current density; (2) the transmission factor of the window, in view of the possible use of a larger span between the fins F (producing less non-perpendicular intersection of electrons and/or better transmission factor); (3) the ability to use a thinner foil 5, which is essential at lower accelerating voltage (150 kV and less) due to the increasing stopping power of the foil 5 with decreasing electron energy; (4) the ability to make wide and extra wide windows for high power and/or long process zones; (5) the ability to make very long windows which are subject to vacuum load or vacuum deflection of the window frame along the fins F; and (6) combinations of the above.

Figure 2A:
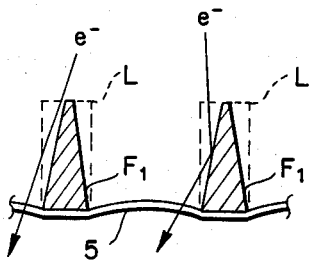
FIGS. 2A and 2B are cross sectional views of the fins of FIG. 1 upon an enlarged scale, showing alternative cross-sectional configurations.
Figure 2B:
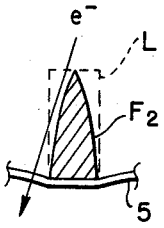

Referring now to FIGS. 2A and 2B, another series of advantages may be obtained by varying the cross-sectional configuration and area of the fins F from the standard rectangular cross-section of prior linear fins, such as shown by dotted lines at L; FIG. 2A showing substantially triangular or somewhat trapezoidal-shaped fins $F_1$, and FIG. 2B illustrating somewhat parabolic-shaped fins $F_2$. Electrons $e^-$ directed toward the window 5 that are not strictly orthogonally directed but travel at a small angle thereto, as shown at the far left in FIG. 2A and FIG. 2B, will not be intercepted as they would be by the rectangular fins L.

Additionally, the sloping sides of the upwardly tapering fins $F_1$ and $F_2$ enable fin-surface reflection of electrons $e^-$ directed at the top of the fin or at small angles, such as up to a few degrees (3°), obviating interception and permitting transmission through the window 5. Reductions in the thermal load stresses on the window 1 result, as do higher electron-beam current densities that can be delivered through the window without deleterious effect. By covering or coating the surface of the fin F facing the electron beam with a material of high atomic number, such as tantalum, better surface reflection of the electron beam toward the atmospheric side of the window can be obtained. The covering of the surfaces of the fins F facing toward the electron beam, and/or the internal side of the foil, with a low atomic number or material element, such as aluminum, on the other hand, would be used to reduce the level of x-rays generated when stopping fast electrons, if this is a more serious problem.

Figure 3A:
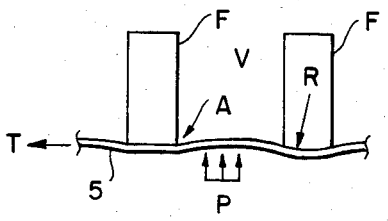
FIGS. 3A and 3B are views similar to FIGS. 2A and 2B showing the contact interface between the fins and the metallic foil of the window.
Figure 3B:
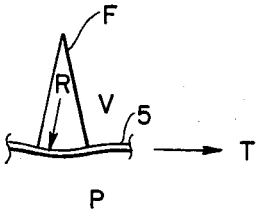

Referring to FIGS. 3A and 3B, corresponding respectively to the fins $F_1$ and $F_2$ of FIGS. 2A and 2B, the vacuum on the fin side of the foil window 5 and the atmospheric pressure P on the opposite or exposed side of the window produce axial tension T on the foil window that inhibits a good contact area between the fins and the foil due to the 'hills and valleys' resultingly produced therein, as shown; this being further aggravated by flat surface contact areas of the fins F, such as points A. It has been found that if the fin-foil contact surface is designed to have a relatively large radius of curvature R (FIGS. 3A and 3B) and a very smooth surface. significant improvement in length of effective contact area with the thinly curved portions of the foil windows is obtained, improving also the heat transfer properties.

Turning, now, to the composition of foil window, titanium foils have been employed. Improved high temperature lifetime, tensile strength and conductivity have been found to result if a bimetallic foil window is constructed from two different extremely thin foils, such as aluminum titanium or copper titanium, bonded together. Advantages resulting from the use of such a bimetallic foil include:

(1) high strength due to the titanium base substrate and (2) better conductivity than that of titanium alone by a factor of 3 to 15 or more, and better conductance in the vacuum between the foil 5 and the fin F. As to the latter, thermal resistance between the foil 5 and the fin F in high vacuum is reduced by copper-to-copper or aluminum-to-copper interfaces, gold and silver being economically non-attractive.

Figure 4:
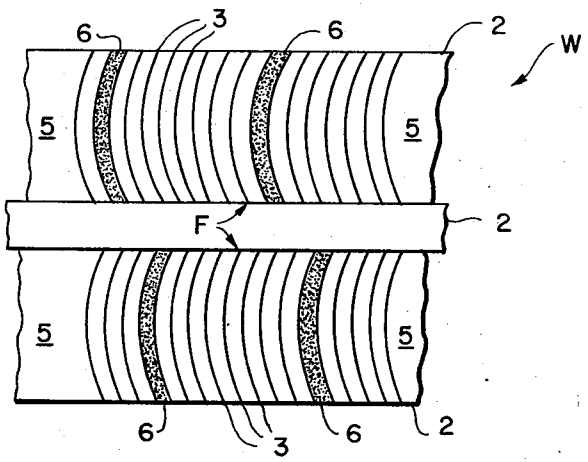
FIG. 4 is a top plan view showing a large window using one of the fin structures of FIG. 1 and with strut supports added for structural integrity.
Figure 5:
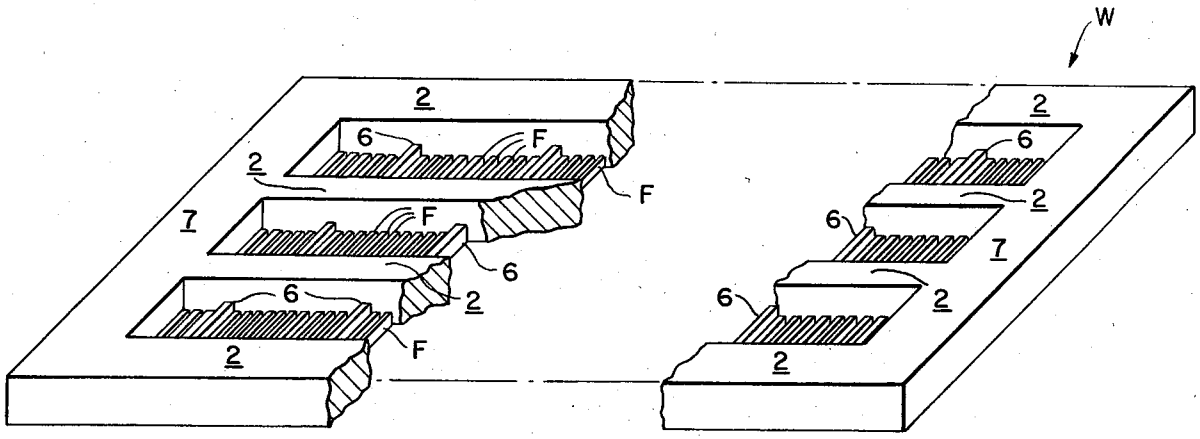
FIG. 5 is an elevation, partly cut away, showing a large window structure constructed in accordance with the present invention.

Optimal utility of the window construction of the invention is provided through the use of an array or plurality of such windows as shown in FIGS. 4 and 5, as in modular form, arranged sided by side (parallel) in a common frame having longitudinal supports 2 and transverse end supports 7. Such a large frame, however, may be subject to severe pressure loads in use, so that intermediate transverse struts 6, serving also as fins of different thickness—in this case thicker—, may be positioned periodically along and in contact with the window structure, between adjacent longitudinal frame supports 2, to prevent buckling under severe pressure loads. It has been determined that such struts 6 should intercept no more than 2% to 10% of the perpendicular electrons and may be longitudinally staggered on adjacent windows, as shown in FIGS. 4 and 5. Such a structure also allows multiple electron beams to be used with a single frame window structure of large dimensions for high performance operation.

While described in connection with its application to the preferred embodiment, it is evident that the improvements underlying the invention herein may also find use in other applications where the advantages of such improvements are also sought; and that other mechanical configurations and modifications for practicing the underlining techniques of the invention will also suggest themselves to those skilled in this art; such, accordingly, being deemed to fall within the spirit and and scope of the invention as defined in the appended claims.

What is claimed is:

1. A high power window for an evacuated electron beam generator and the like having, in combination, a longitudinally extending metallic foil window closing off the vacuum, and one or more pluralities of sets of successive parallely and closely spaced arcuately extending conductive fins held by the vacuum pressure to the inner surface of the foil and curving transversely across said inner surface between its longitudinal edges.

2. A high power window as claimed in claim 1, in which the curve of the metallic fins is at least in part one of C- and S- shape.

3. A high power window as claimed in claim 2 and in which the cross-section of the fins tapers from the foil inward of the vacuum.

4. A high power window as claimed in claim 3, in which said fins are of substantially parabolic shape in cross-section.

5. A high power window as claimed in claim 3, in which said fins are of substantially triangular or trapezoidal cross-section.

6. A high power window as claimed in claim 1, in which the plurality of metallic fins includes fins of different cross-sectional thickness.

7. A high power window as claimed in claim 1, in which at least portions of the fins are covered with a high atomic number element to increase electron beam reflection properties.

8. A high power window as claimed in claim 7 in which the high atomic number element is tantalum.

9. A high power window as claimed in claim 1, in which a portion of the fins are covered with a low atomic number element to reduce x-ray generation from electron contact with the fins.

10. A high power window as claimed in claim 9 in which the low atomic number element is aluminum.

11. A high power window as claimed in claim 1 in which the metallic foil has a low atomic number element on the surface facing the electron beam to reduce x-ray generation from electron contact with the foil.

12. A high power window as claimed in claim 11 in which the low atomic number element is aluminum.

13. A high power window as claimed in claim 2, in which the metallic foil is a bimetallic foil.

14. A high power window as claimed in claim 13, in which the bimetallic foil includes titanium.

15. A high power window as claimed in claim 13 in which the bimetallic foil includes copper.

16. A high power window as claimed in claim 1 in which the surface of the fins secured to the window is curved to attach to somewhat curved portions of the window.

* * * * *